US008878737B2

(12) United States Patent
Rao

(10) Patent No.: US 8,878,737 B2
(45) Date of Patent: Nov. 4, 2014

(54) SINGLE FEED PLANAR DUAL-POLARIZATION MULTI-LOOP ELEMENT ANTENNA

(75) Inventor: Qinjiang Rao, Waterloo (CA)

(73) Assignee: BlackBerry Limited, Waterloo (CA)

( * ) Notice: Subject to any disclaimer, the term of this patent is extended or adjusted under 35 U.S.C. 154(b) by 650 days.

(21) Appl. No.: 12/494,246

(22) Filed: Jun. 29, 2009

(65) Prior Publication Data

US 2010/0328173 A1 Dec. 30, 2010

(51) Int. Cl.

| | |
|---|---|
| ***H01Q 7/00*** | (2006.01) |
| ***H01Q 1/36*** | (2006.01) |
| ***H01Q 21/20*** | (2006.01) |
| ***H01Q 1/24*** | (2006.01) |
| ***H01Q 21/24*** | (2006.01) |
| ***H01Q 1/38*** | (2006.01) |

(52) U.S. Cl.

CPC ..... *H01Q 7/00* (2013.01); *H01Q 21/205* (2013.01); *H01Q 1/242* (2013.01); *H01Q 21/24* (2013.01); *H01Q 1/38* (2013.01)

USPC ..... 343/742; 343/700 MS; 343/843; 343/867

(58) Field of Classification Search

CPC ..... H01Q 1/242; H01Q 1/38; H01Q 21/205; H01Q 21/24; H01Q 7/00

USPC ..... 343/741–744, 700 MS, 866, 868, 870

See application file for complete search history.

(56) References Cited

U.S. PATENT DOCUMENTS

| | | | | |
|---|---|---|---|---|
| 3,290,688 | A * | 12/1966 | Kraus | 343/731 |
| 4,804,965 | A * | 2/1989 | Roederer | 343/700 MS |
| 5,592,182 | A | 1/1997 | Yao et al. | |
| 6,160,525 | A * | 12/2000 | Lopez | 343/866 |
| 6,400,337 | B1 * | 6/2002 | Handelsman | 343/867 |
| 7,394,426 | B2 * | 7/2008 | Ogawa et al. | 343/700 MS |
| 7,511,670 | B2 | 3/2009 | Rao et al. | |
| 2003/0103015 | A1 | 6/2003 | Oh et al. | |

(Continued)

FOREIGN PATENT DOCUMENTS

| | | | |
|---|---|---|---|
| EP | 0806808 | A2 | 12/1997 |
| EP | 1033782 | A2 | 9/2000 |

(Continued)

OTHER PUBLICATIONS

Nakano, H.; Suzuki, N.; Ishii, T.; Yamauchi, J., "Mesh antennas for dual polarization," Antennas and Propagation, IEEE Transactions on , vol. 49, No. 5, pp. 715,723, May 2001.*

(Continued)

*Primary Examiner* — Robert Karacsony

*Assistant Examiner* — Amal Patel

(74) *Attorney, Agent, or Firm* — Moffat & Co.

(57) ABSTRACT

Dual polarization in an antenna structure that results from a number of radiating elements arranged in a loop configuration. The antenna structure is excited by a single coaxial feedline in an interior portion of the antenna structure. The antenna structure may include a ground plane that enables a directional radiation pattern. The antenna structure may also be operational without a ground plane to enable an omnidirectional radiation pattern. The antenna structure may be configured in a number of loop configurations electrically connected to each other by a number of microstrip loops extending in a horizontal and vertical planar direction.

6 Claims, 10 Drawing Sheets

(56) References Cited

U.S. PATENT DOCUMENTS

| | | | | |
|---|---|---|---|---|
| 2003/0112193 | A1 | 6/2003 | Briggs | |
| 2003/0156069 | A1* | 8/2003 | Ooe et al. | 343/713 |
| 2005/0253763 | A1* | 11/2005 | Werner et al. | 343/745 |
| 2007/0052590 | A1* | 3/2007 | Chang et al. | 343/700 MS |
| 2007/0111690 | A1 | 5/2007 | Nagy | |
| 2007/0252763 | A1 | 11/2007 | Martin | |
| 2008/0252550 | A1 | 10/2008 | Rao et al. | |

FOREIGN PATENT DOCUMENTS

| | | | |
|---|---|---|---|
| GB | 2074792 | A | 11/1981 |
| JP | 10 247818 | A | 9/1998 |
| JP | 2007235682 | A | 9/2007 |
| JP | 2008048005 | | 2/2008 |
| JP | 2008048005 | A | 2/2008 |
| WO | WO 2004/075342 | A1 | 9/2004 |

OTHER PUBLICATIONS

Adrian et al., "Dual aperture-coupled microstrip antenna for dual or circular polarization", Electronics Letters, vol. 23, No. 23, Nov. 1987, pp. 1226-1228.

Parker et al., "Dual-polarized microstrip ring antenna with good isolation", Electronics Letters, May 1998, vol. 34, No. 11, pp. 1043-1044.

Extended EP Search Report for EP Patent Application No. 10167719.3 dated Apr. 14, 2011.

Hirose, K. et al., Circularly Polarized Loop-Line Antennas: Fundamental Study on Dual Polarization, Electronics & Communications in Japan, No. US LNKD- D01:10.002/ECJA 20219, Jan. 1, 2005, pp. 9-18.

Partial EP Search Report for EP Patent Application No. 10167719.3 dated Oct. 4, 2010.

EP Office Action for EP Patent Application No. 10167719.3 dated Feb. 9, 2012.

* cited by examiner

SINGLE FEED PLANAR DUAL-POLARIZATION MULTI-LOOP ELEMENT ANTENNA

CROSS-REFERENCE TO RELATED APPLICATIONS

This application is related to U.S. Pat. No. 7,511,670, dated Mar. 31, 2009 to Rao et al., and entitled Dual-Polarized, Multiple Strip-Loop Antenna, and Associated Methodology for Radio Device, which is herein incorporated by reference for all purposes.

BACKGROUND

1. Technical Field

This disclosure relates to wireless communications and more specifically to the design and implementation of a dual-polarization planar antenna in a base station to enable polarization diversity.

2. Description of the Related Art

Polarization diversity improves wireless performance by enabling a wireless device to transmit a signal at multiple polarizations, because the polarization sensitivity of the distant end antenna may be unknown or uncontrolled. It may also be important to improve signal transmission and reception quality in wireless communication systems that have a multiplicity of radio frequency (RF) propagation problems. One way of improving polarization diversity is to achieve dual, orthogonal polarization sensitivity in an antenna. An example of a dual polarization antenna is a structure that can support simultaneous transmission or reception of both horizontally polarized and vertically polarized radiation of electromagnetic waves.

Achieving dual polarization is often achieved by connecting each of multiple feeds to a different point on a single antenna structure, such that one feed excites currents that support one polarization, while a separate feed excites currents that support the orthogonal polarization.

BRIEF DESCRIPTION OF THE DRAWINGS

For a better understanding of how this disclosure and the various embodiments described herein, reference is now made to the following brief description, taken in connection with the accompanying drawings and detailed description, which show at least one exemplary embodiment.

DETAILED DESCRIPTION

Figure 1A:
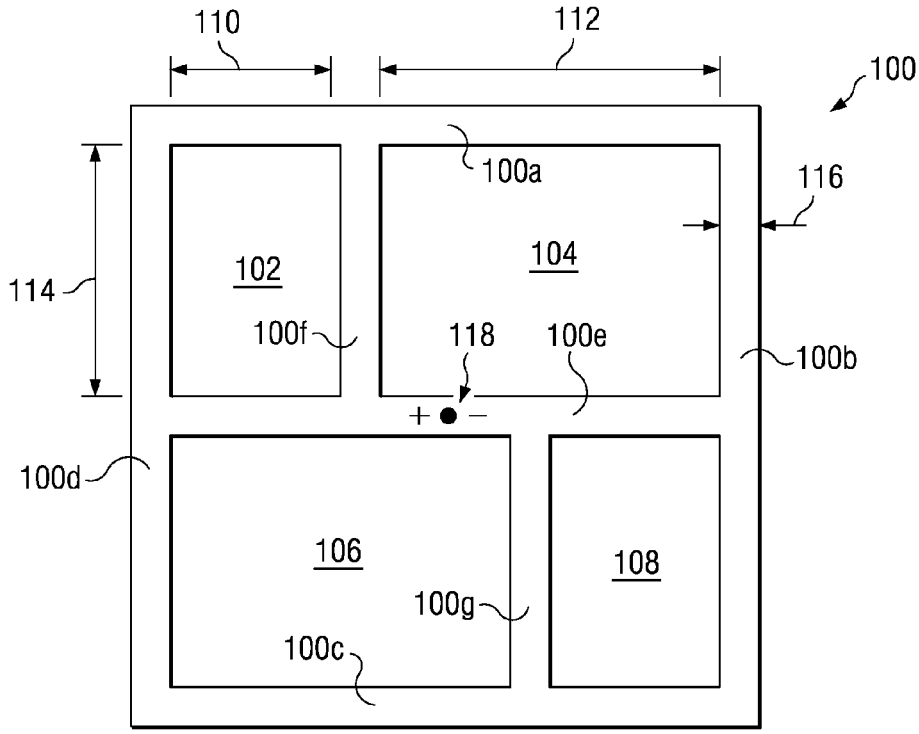
FIG. 1A illustrates a dual-polarization antenna in accordance with one embodiment of the present disclosure.

It should be understood at the outset that although an illustrative implementation of one or more embodiments are provided below, the description is not to be considered as limiting the scope of the embodiments described herein. The disclosure may be implemented using any number of techniques, whether currently known or in existence. The disclosure should in no way be limited to the illustrative implementations, drawings, and techniques illustrated below, including the exemplary designs and implementations illustrated and described herein, that may be modified within the scope of the appended claims along with the full scope of equivalents. It would be appreciated that for simplicity and clarity of illustration, where considered appropriate, reference numerals may be repeated among the figures to indicate corresponding or analogous elements.

The present disclosure provides a planar dual-polarization antenna comprised of microstrip elements placed end-to-end in the shape of a rectangular loop. The microstrip elements are conductive elements that may be formed from a thin film of metal, such as copper, gold, nichrome, and other such transmission line metals know to one skilled in the art. The thickness of the metal selected may be based on the application. A number of microstrip elements may be symmetrically oriented within the planar antenna to form an array of rectangular shaped loops. As used herein, "a number of" items refers to one or more items.

The number of rectangular shaped loops formed by the microstrip elements within the antenna structure affects the antenna gain. A single feed is disposed at an interior point of the planar antenna. The interior point may be one specific interior point located at the center of the antenna structure. The single feed excites the plurality of rectangular shaped loops that are symmetrically oriented within the antenna structure. The antenna gain increases with the number of rectangular shaped loops formed by the microstrip elements. FIG. 1 and FIGS. 5-7, discussed in detail later herein, provide embodiments of exemplary configurations of a dual-polarization planar antenna formed using a plurality of microstrip elements configured in an arrangement of rectangular loops. The increased number of microstrip elements in a horizontal and vertical directions increase Referring first to FIG. 1A, a dual-polarization microstrip loop antenna is illustrated according to one embodiment of the present disclosure. The dual-polarization planar antenna 100 is comprised of contiguous microstrip elements 100*a*,

100*b*, 100*c* and 100*d* that are electrically connected to form strip loops 102, 104, 106, and 108. In one embodiment, the dual polarization planar antenna 100 and the strip loops 102, 104, 106, and 108 may be rectangular-shaped. Microstrip elements 100*a*, 100*b*, 100*c* and 100*d* may be of a same width 116.

A single feed 118 disposed at one specific interior point of the antenna structure 100 may carry current that symmetrically excites strip loops 102, 104, 106, and 108. In one embodiment, the single specific point may be located at the center of antenna structure 100. The center may be considered to be at a midpoint of the orthogonal x and y axes of antenna 100.

In some embodiments, the perimeter of the dual-polarization planar antenna 100 may be equal to a wavelength or one lambda at the operational frequency. In the embodiment illustrated in FIG. 1A, each microstrip element is composed of four microstrip elements that are identical in length, each microstrip element being approximately one-quarter lambda in length. A number of additional planar microstrip elements may be placed within the perimeter of the antenna structure to form strip loops of various rectangular configurations. For example, in FIG. 1A, microstrip 100*e* is placed in the center of the antenna structure space 100. An additional microstrip element 100*f* results in a formation of strip loops 102 and 104.

Additionally, the placement of microstrip element 100*g* enables the formation of the strip loops 106 and 108. In this embodiment, the microstrip elements have the same width 116. It must be emphasized that the placement of microstrip elements 100*e*, 100*f*, and 100*g* within planar antenna 100 to form strip loops 102, 104, 106 and 108 is exemplary. Strip loops 102, 104, 106 and 108 may be formed by an arrangement or placement of microstrip elements of varying lengths and widths as may be recognized by one skilled in the art. For example, microstrip element 100*e* may be comprised of two portions of a certain length that are conjoined. A first portion of microstrip element 100*e* may form a portion of strip loop 102 and a second portion of microstrip element 100*e* may form a portion of strip loop 104.

The rectangular loops formed within the dual-polarization antenna 100 may be adjusted in size to obtain a particular antenna frequency and gain. In general, an increase in the number of loops within the antenna results in increased gain. A single feed point 118 physically connected to a coaxial cable (not shown) may be used to source current that excites the microstrip radiating elements of rectangular loop structures 102, 104, 106, and 108 of antenna structure 100.

Figure 1B:
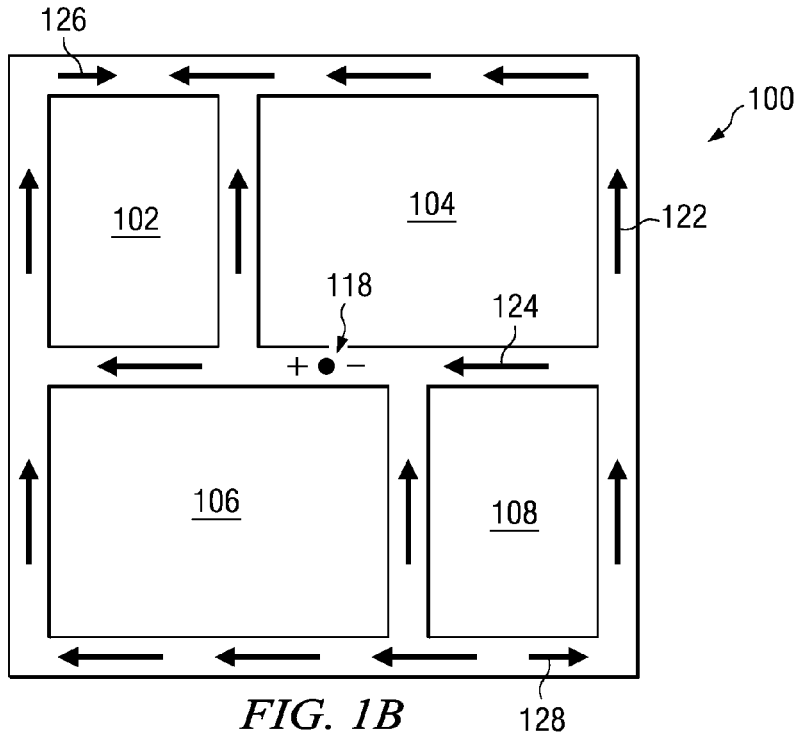
FIG. 1B illustrates a snapshot in time of one possible current distribution in the antenna of FIG. 1A according to one embodiment of the present disclosure.

FIG. 1B illustrates a snapshot in time of a simulated current distribution of the dual-polarization antenna 100 of FIG. 1A. In FIG. 1B, the current distribution may run along the orthogonal x and y axes. The current is input from the coaxial cable to feed point 118 and is distributed in a horizontal direction 124 and vertical direction 122. At a distance of one-half lambda the current may change direction as illustrated by current elements 126 and 128.

Figure 2:
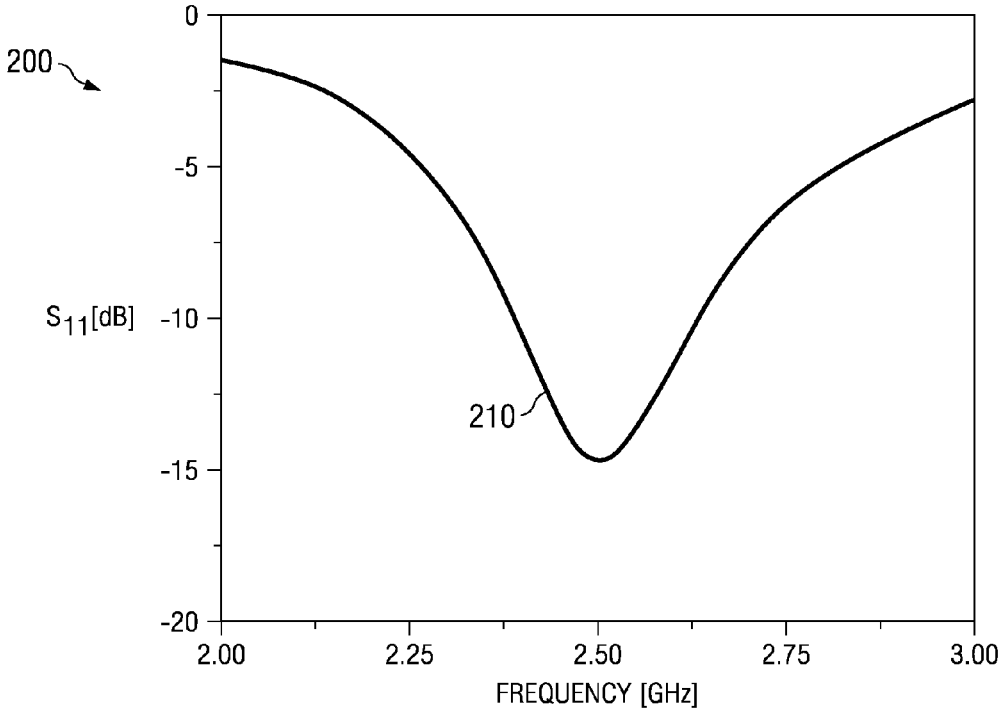
FIG. 2 illustrates a plot of the return loss measured for the antenna illustrated in FIG. 1A.

In FIG. 2, graph 200 illustrates the return loss of the antenna measured at a base station receiver. The return loss plot 210 illustrates that the resident frequency of the antenna is within a wireless local area network (WLAN) band. The WLAN band ranges from between 2.45 gigahertz (GHz) and 5.56 GHz.

Figure 3:
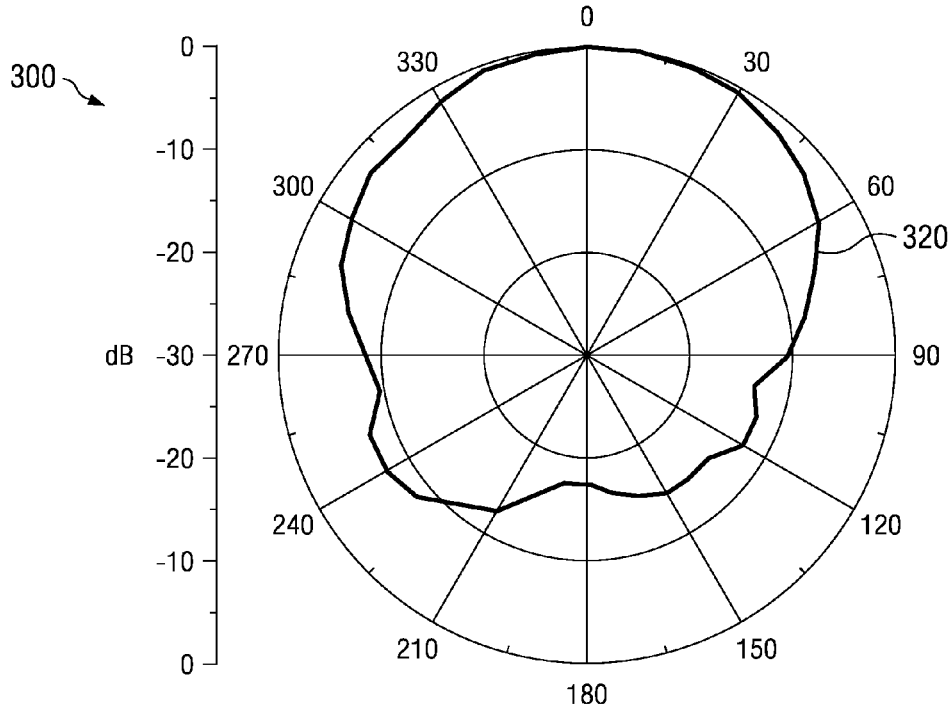
FIG. 3 is a XOZ plot of the radiation pattern at a wireless local area network (WLAN) frequency of the antenna illustrated in FIG. 1A.

Turning now to FIG. 3, the far-field radiation pattern measured for the antenna of FIG. 1A and FIG. 1B is illustrated at a resident frequency of 2.45 GHz. The radiation pattern 320 shows radiation directivity in the XZ plane. In this embodiment, the radiation directivity of the radiation indicates the presence of a ground plane.

Figure 4:
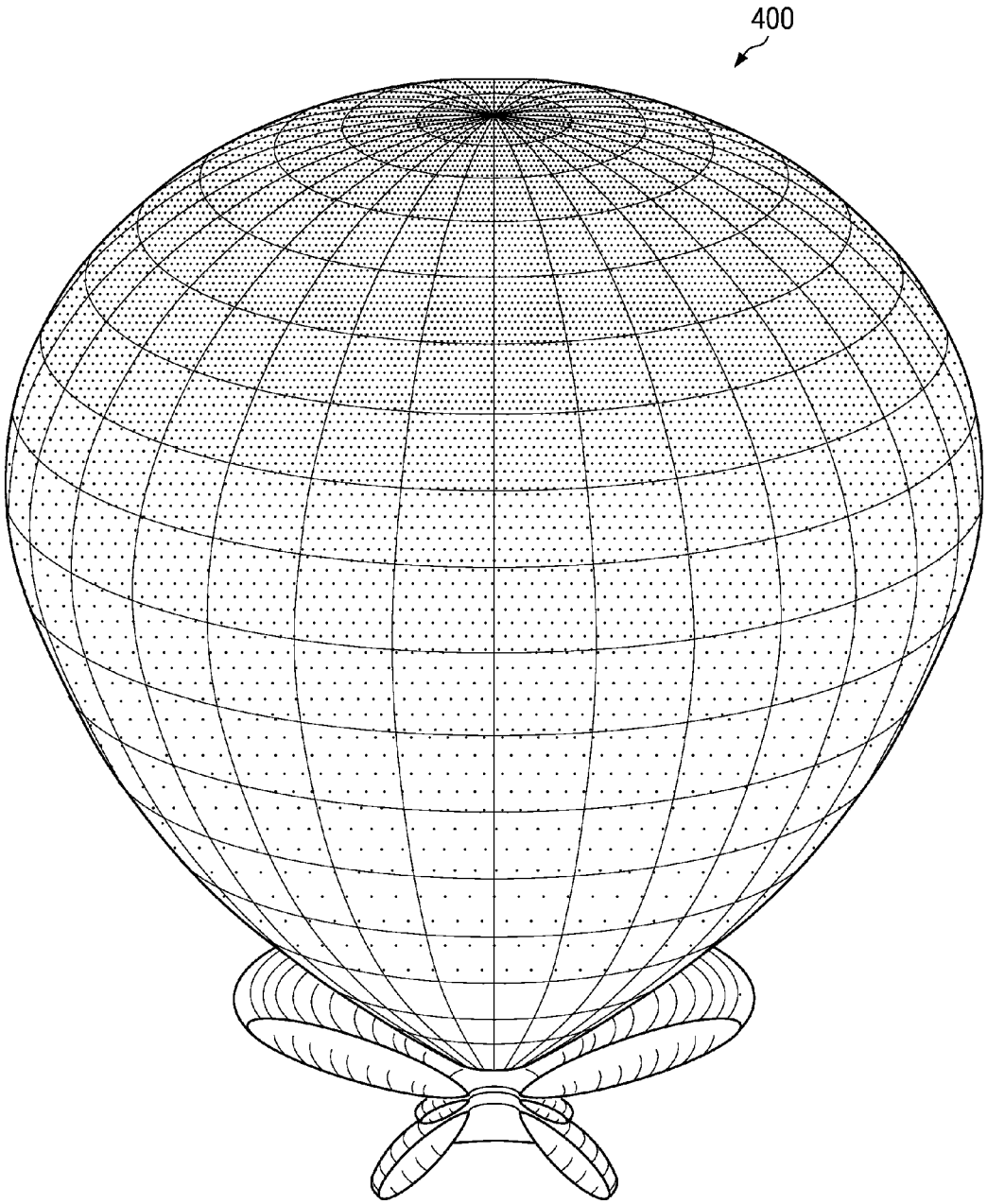
FIG. 4 is a three dimensional view of the radiation pattern of the configuration of the antenna illustrated in FIG. 3.

In FIG. 4, radiation pattern 400 represents another view of the radiation pattern depicted in FIG. 3. Radiation pattern 400 illustrates an exemplary three dimensional radiation pattern produced by the antenna depicted in FIG. 1A and FIG. 1B.

Figure 5A:
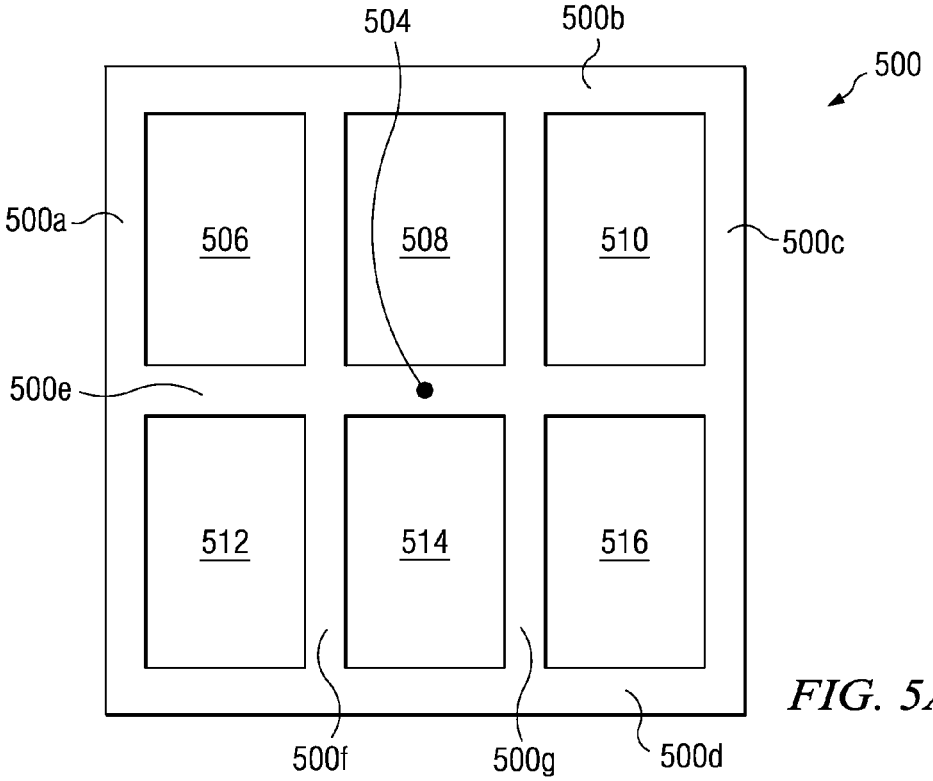
FIG. 5A is a configuration of another dual-polarization antenna according to another embodiment of the disclosure.

Referring now to FIG. 5A, another configuration of a dual-polarization planar antenna 500 is illustrated. Antenna 500 is configured as a 2 by 3 array of rectangular strip loops 506, 508, 510, 512, 514, and 516. The dual-polarization planar antenna 500 is comprised of contiguous microstrip elements 500*a*, 500*b*, 500*c* and 500*d* that are electrically connected to form a perimeter of rectangular shape. In some embodiments, the perimeter of the dual-polarization planar antenna 500 may be equal to a wavelength or one lambda.

A number of additional planar microstrip elements may be placed within the perimeter of the antenna structure to form strip loops of various rectangular configurations. For example, the 2 by 3 array of rectangular strip loops 506, 508, 510, 512, 514, and 516 may be formed by the placement of horizontal microstrip element 500*e* and vertical microstrip elements 500*f* and 500*g*.

In one embodiment, the strip loops 506, 508, 510, 512, 514, and 516 formed by the placement of additional microstrip elements may be rectangular in shaped and identical in shape. A single feed 504 disposed at one specific interior point of the antenna structure 500 may carry current that symmetrically excites strip loops 506, 508, 510, 512, 514, and 516. In one embodiment, the specified interior point may be located at a center of the antenna structure 500. The center may be considered as a midpoint of the orthogonal x and y axes of antenna structure 500.

Figure 5B:
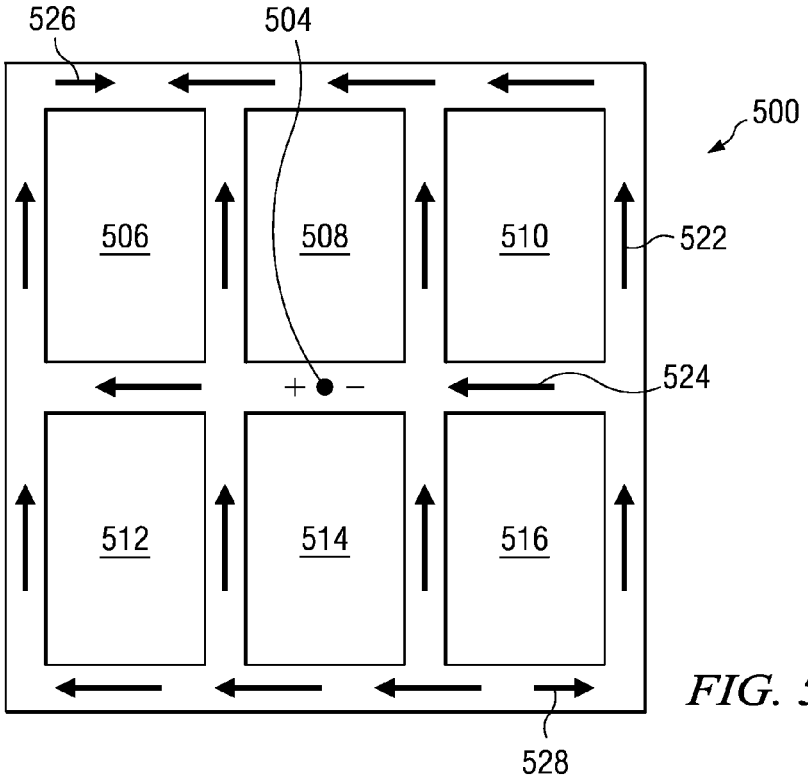
FIG. 5B illustrates an exemplary current distribution at a specific point in time of the antenna illustrated in FIG. 5A.

FIG. 5B illustrates a snapshot in time of a simulated current distribution of the dual-polarization antenna 500 of FIG. 5A. In FIG. 5B, the current distribution may run along the orthogonal x and y axes. The current is input from the coaxial cable feed point 504 and is distributed in a horizontal direction 524 and vertical direction 522. At a distance of about one-half lambda the current may change direction as illustrated by current element 526 and 528.

Figure 6A:
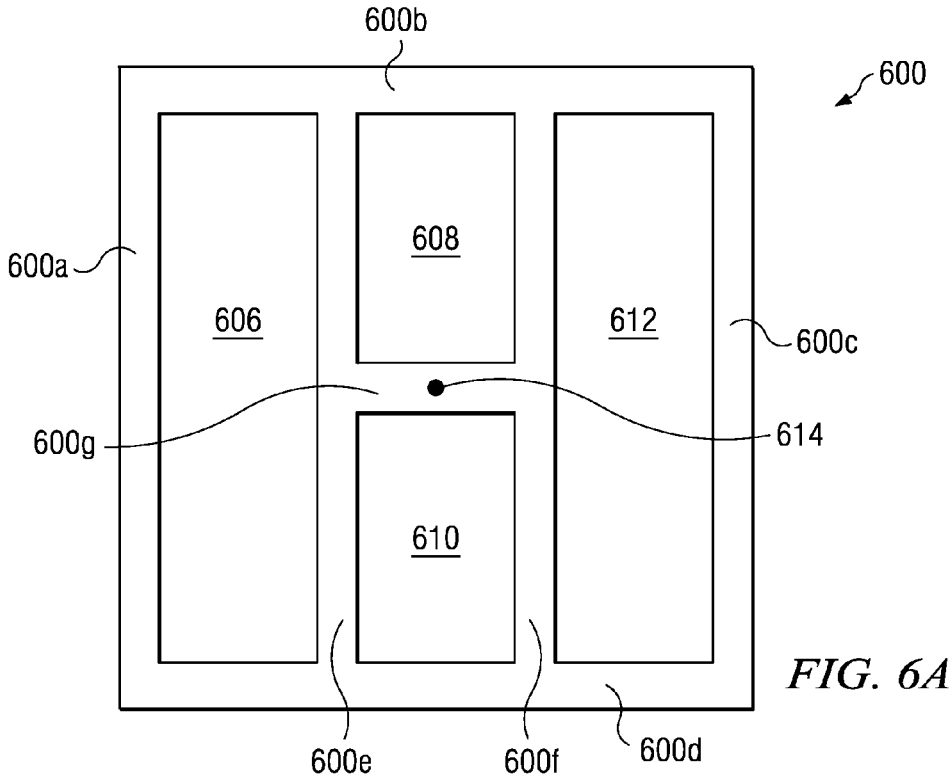
FIG. 6A is another configuration of a dual-polarization antenna according to another embodiment of the disclosure.

Turning now to FIG. 6A, another configuration of a dual-polarization planar antenna 600 is illustrated. The dual-polarization planar antenna 600 is comprised of contiguous microstrip elements 600*a*, 600*b*, 600*c* and 600*d* that are electrically connected to form a perimeter of rectangular shape. In some embodiments, the perimeter of the dual-polarization planar antenna 600 may be equal to a wavelength of one lambda.

A number of additional planar microstrip elements may be placed within the perimeter of the antenna structure to form strip loops of various rectangular configurations. For example, array of rectangular strip loops 606, 608, 610, and 612 may be formed by the placement of vertical microstrip elements 600*e* and 600*f* and horizontal microstrip element 600*g*. In one embodiment, the strip loops 606 and 612 may be identical in shape. Strip loops 608 and 610 may also have an identical shape different from the strip loops 606 and 612. A single feed 614 disposed at one specific interior point of the antenna structure 600 may carry current that symmetrically excites strip loops 606, 608, 610, and 612. In one embodiment, the specific interior point may be located at a center of the antenna structure 500. The center may be considered as a midpoint of the x and y axes of antenna structure 600.

Figure 6B:
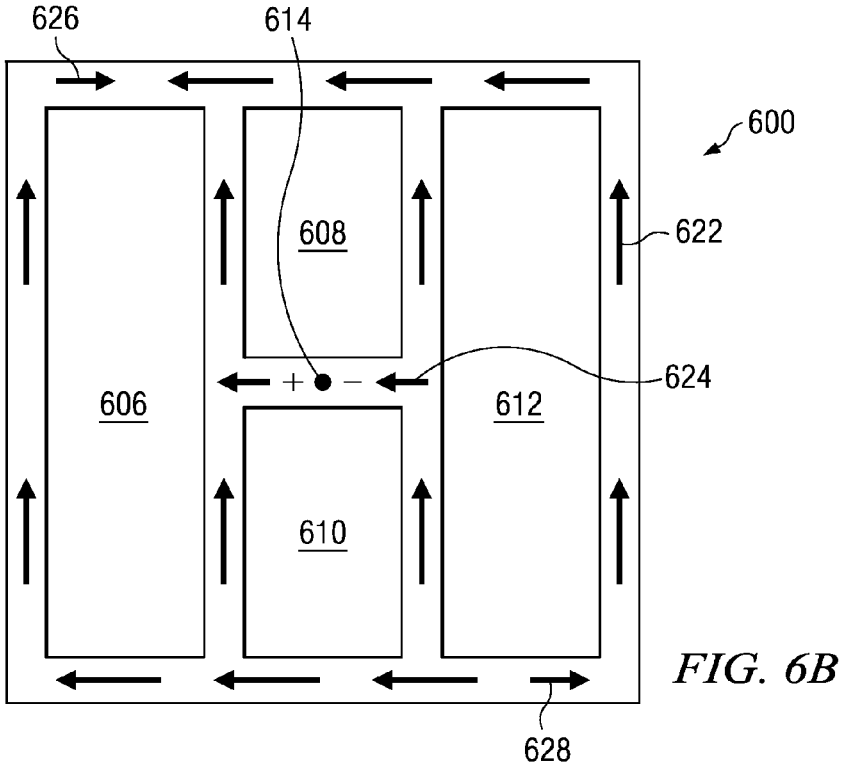
FIG. 6B illustrates an exemplary current distribution at a specific time of the antenna illustrated in FIG. 6A.

FIG. 6B illustrates a snapshot in time of a simulated current distribution of the dual-polarization antenna 600 of FIG. 6A. In FIG. 6B, the current distribution may run along the orthogonal x and y axes. The current is input from the coaxial cable feed point 614 and is distributed in a horizontal direction 624 and vertical direction 622. At a distance of about one-half lambda the current may change direction as illustrated by current element 626 and 628.

Figure 7A:
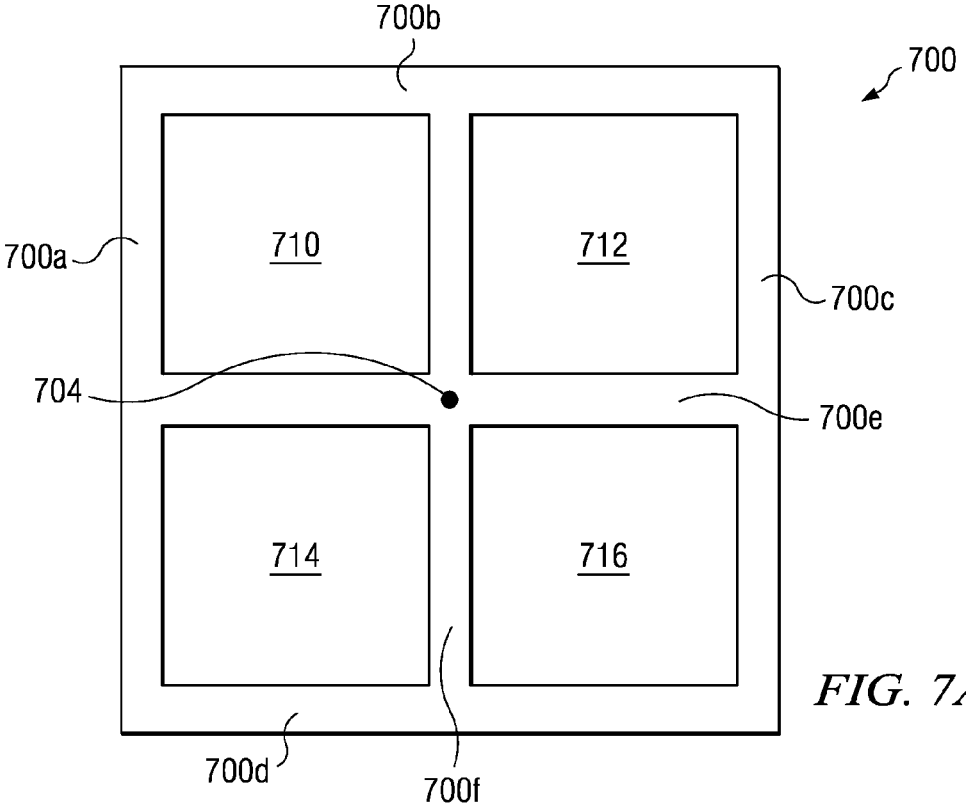
FIG. 7A illustrates another configuration of a dual-polarization antenna according to another embodiment of the disclosure.

Referring now to FIG. 7A is another embodiment of a configuration of a strip loop antenna is illustrated. The dual-polarization planar antenna 700 is configured as a 2 by 2 array of contiguous microstrip elements 700*a*, 700*b*, 700*c* and 700*d* that are electrically connected to form a perimeter of rectangular shape. In some embodiments, the perimeter of the dual-polarization planar antenna 700 may be equal to a wavelength of one lambda.

A number of additional planar microstrip elements may be placed within the perimeter of the antenna structure to form strip loops of various rectangular configurations. For example, the 2 by 2 array of rectangular strip loops 710, 712, 714, and 716 may be formed by the placement of horizontal microstrip element 700*e* and vertical microstrip element 700*f*. In one embodiment, the strip loops 710, 712, 714, and 716 may be identical in shape. A single feed 704 disposed at one specific interior point of the antenna structure 700 may carry current that symmetrically excites strip loops 710, 712, 714, and 716. In one embodiment, the specific interior point may be located at a center of the antenna structure 500. The center may be considered as a midpoint of the x and y axes of antenna structure 700.

Figure 7B:
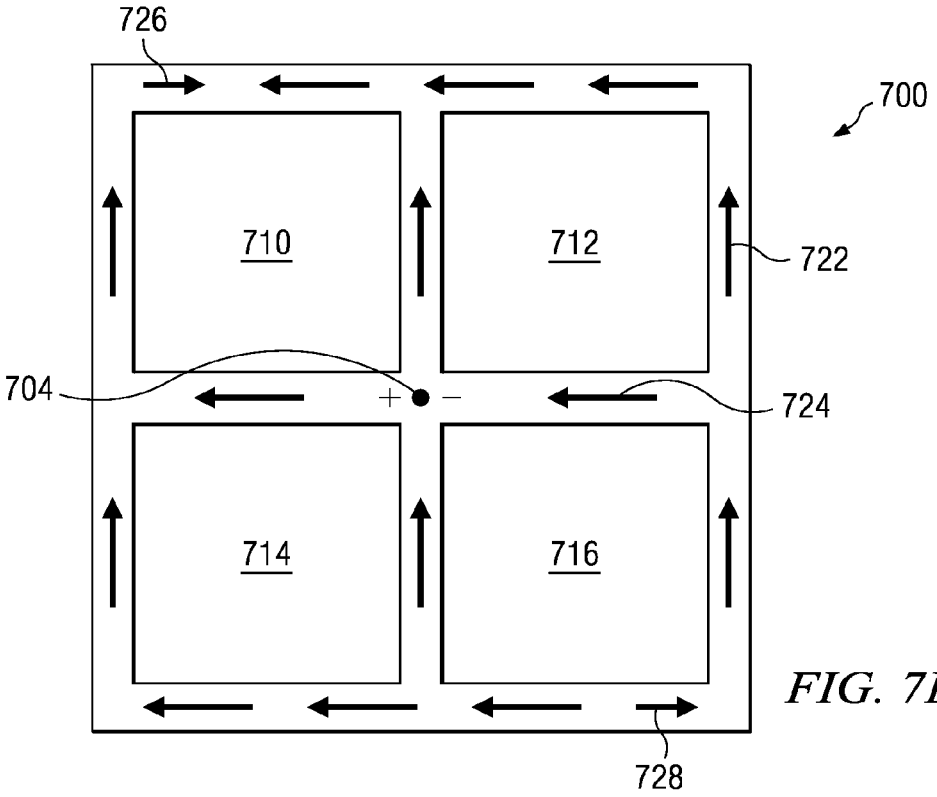
FIG. 7B illustrates an exemplary current distribution at a specific point in time of the dual-polarization antenna illustrated in FIG. 7A.

FIG. 7B illustrates a snapshot in time of a simulated current distribution of the dual-polarization antenna 700 of FIG. 7A. In FIG. 7B, the current distribution may run along the orthogonal x and y axes. The current is input from the coaxial cable feed point 704 and is distributed in a horizontal direction 724 and vertical direction 722. At a distance of about one-half lambda the current may change direction as illustrated by current element 726 and 728.

Figure 8A:
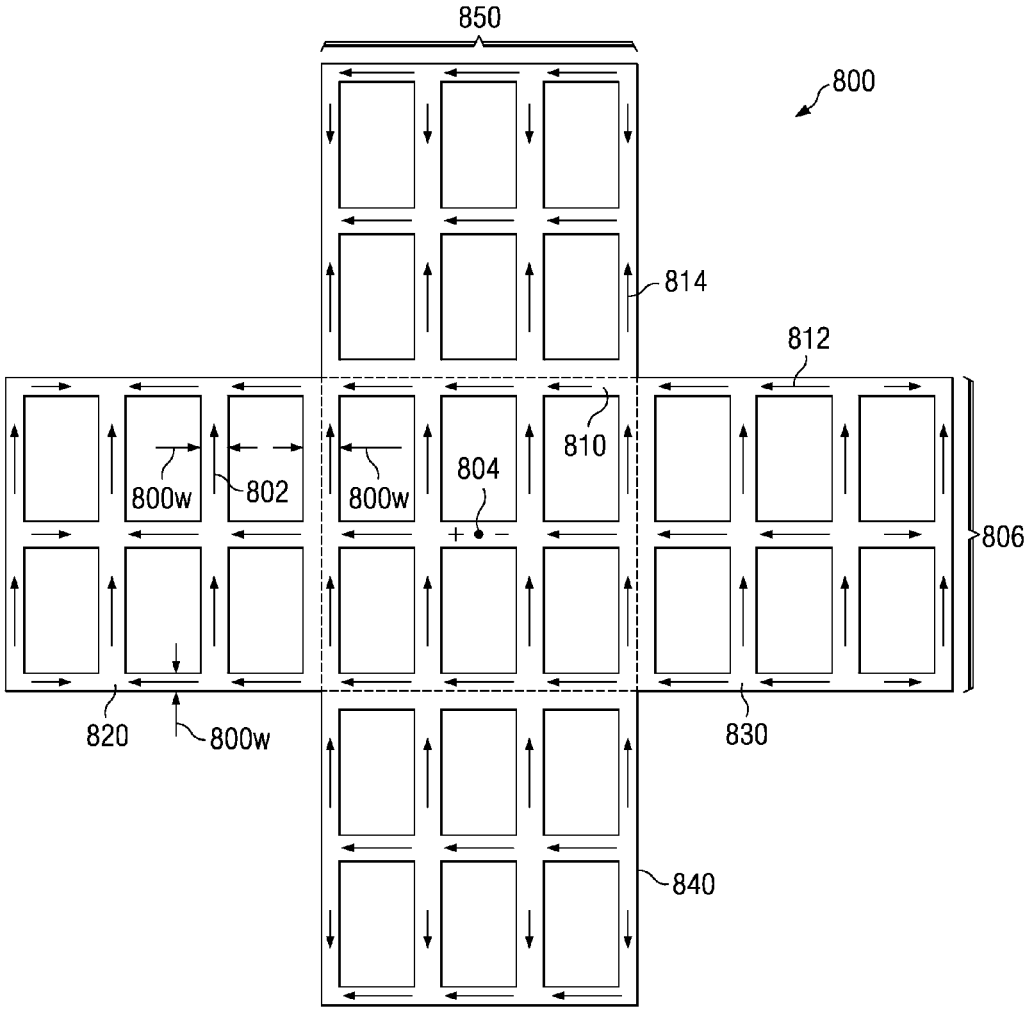
FIG. 8A illustrates an array of antennas using the embodiment of the antenna illustrated in FIG. 5A.

Referring now to FIG. 8A, antenna structure 800 illustrates a formation of a number of identical dual-polarization planar antennas such as the dual-polarization planar antenna illustrated in FIG. 5A. In one embodiment, planar antenna structure 800 is formed by the contiguous formation of antennas 810, 820, 830, 840 and 850 that are electrically connected. In one embodiment, the perimeter of each planar antenna is equal to one lambda. Each planar antenna may be formed by the placement of microstrip elements of a same width, such as width 800*w*. In some embodiments, antenna structure 800 may include a ground plane. It must be noted that antenna structure 800 may be comprised of structures of the same or differing configurations.

In FIG. 8A, a current may be carried to the structure through a single coaxial feed 804 disposed at one specific interior point of the structure. The single feed 804 may distribute current that symmetrically excites the strip loops of planar antennas 810, 820, 830, 840 and 850. The current distribution may be planar and run along orthogonal x and y axes as illustrated by current elements 812 and 814, respectively. In one embodiment, the single specific interior point may be located at a center of the antenna structure 800.

Figure 8B:
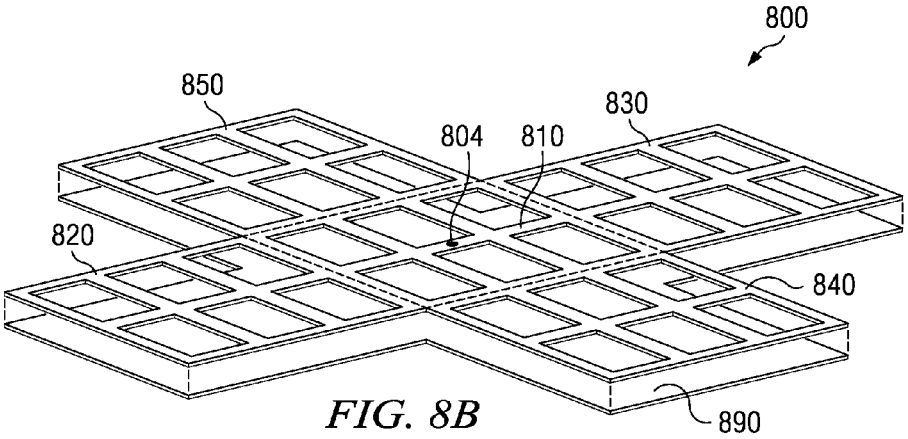
FIG. 8B illustrates the array of antennas as depicted in FIG. 8A including the presence of a ground plane.

Turning now to FIG. 8B, antenna structure 800 illustrates the dual-polarization planar antenna illustrated in FIG. 8A with a ground plane 890 according to one embodiment of the disclosure. The presence of the ground plane affects the antenna directivity.

Figure 8C:
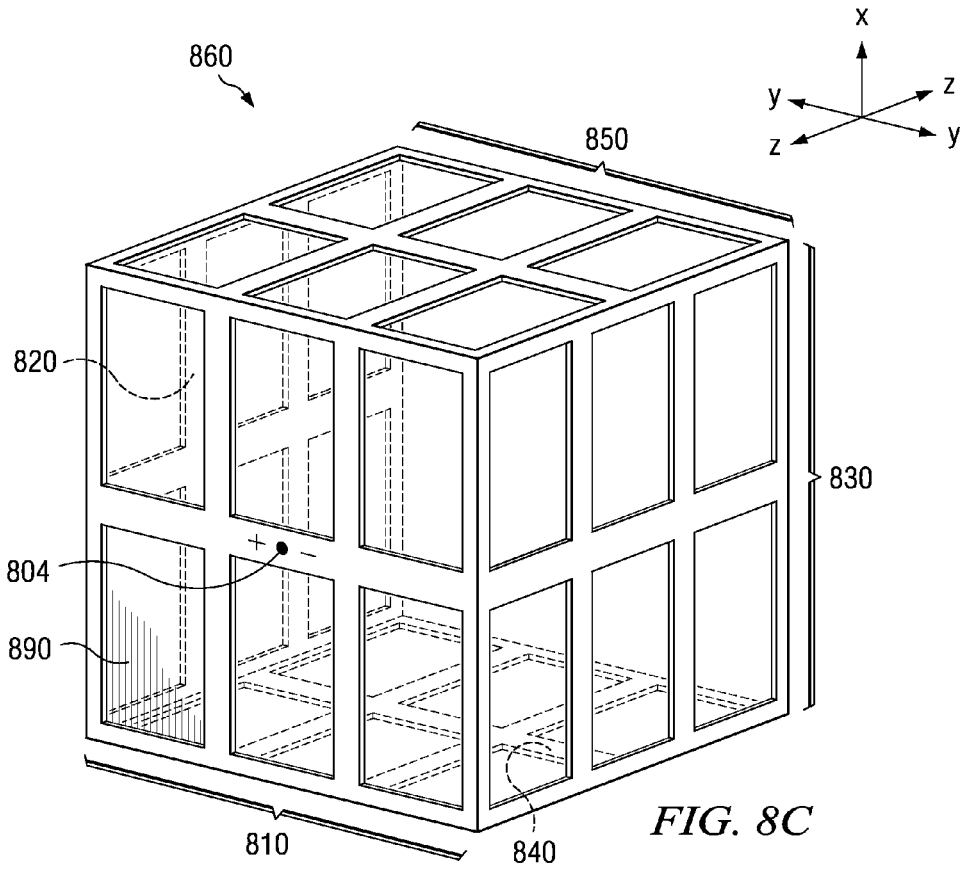
FIG. 8C illustrates a folding of the array of antennas using the embodiment illustrated in FIG. 8A.

FIG. 8C illustrates a three dimensional antenna folded structure 860 of antenna structure 800 of FIG. 8A folded into the Z plane. In FIG. 8B, planar antennas 820, 830, 840 and 850 may be folded downward in an orthogonal direction to X-Y plane for increased reception. The folded antenna structure 860 may have a radiation pattern that is omnidirectional.

Figure 8E:
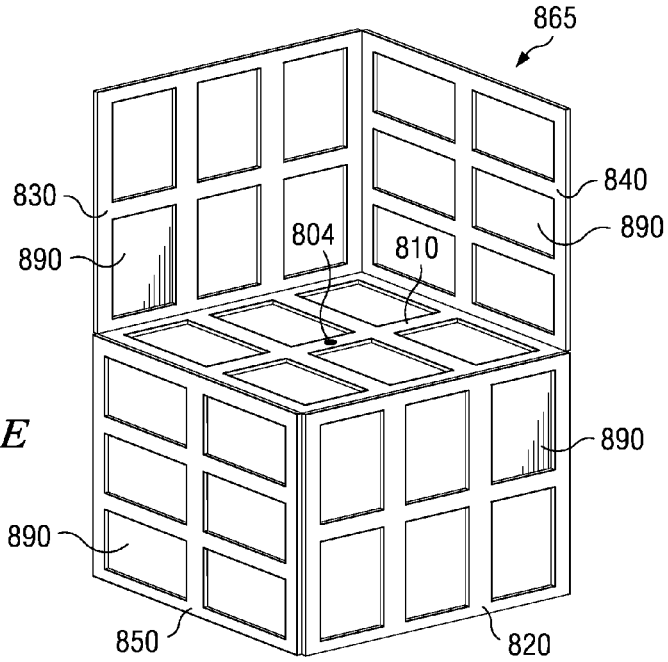
FIG. 8E illustrates another embodiment of the folding of the array of antennas illustrated in FIG. 8A.
Figure 8D:
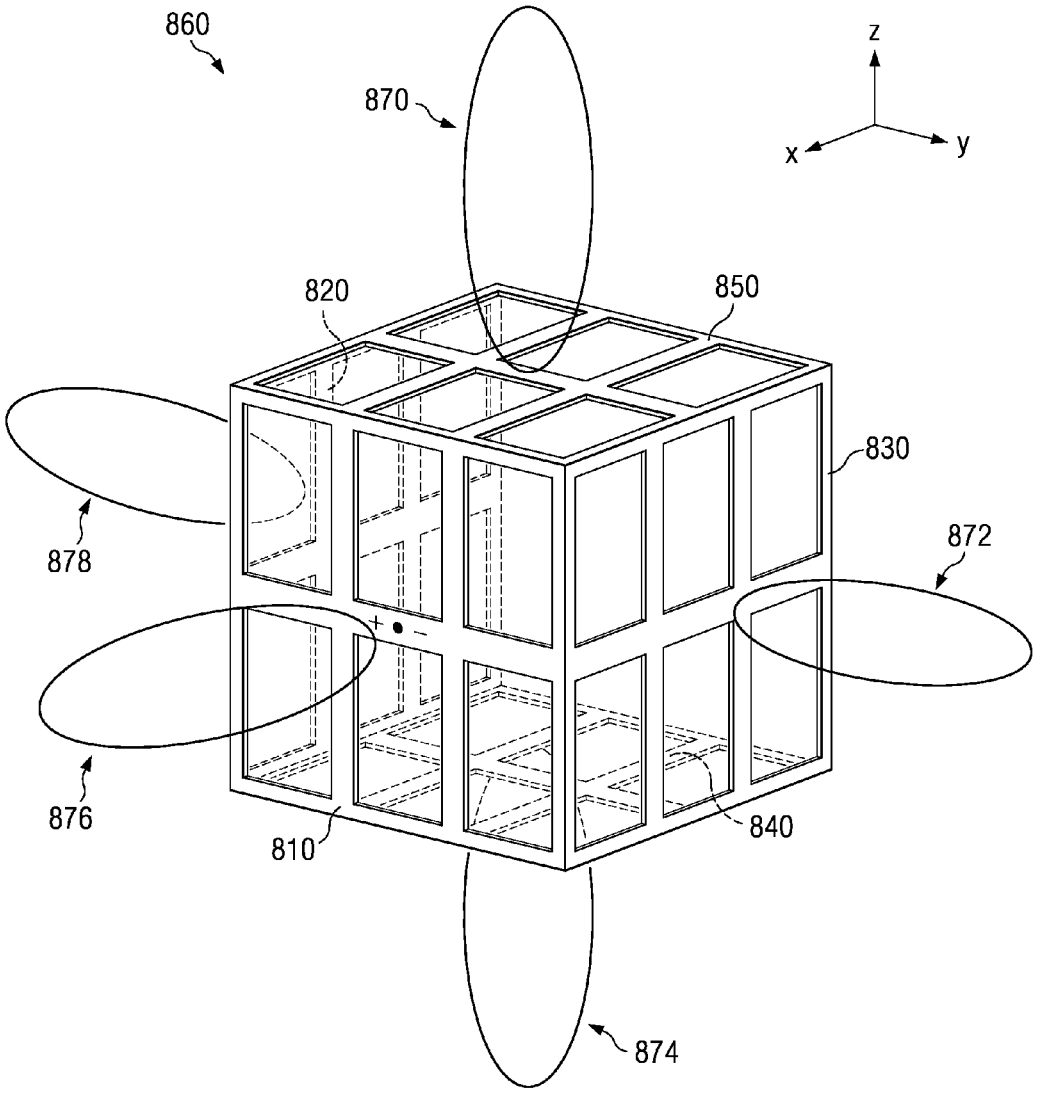
FIG. 8D is a diagram of the radiation directions based on the embodiment of the folded antenna illustrated in FIG. 8C.

FIG. 8D illustrates an exemplary top level radiation pattern produced by three dimensional antenna structure 860. The radiation pattern is illustrated by radiating shapes represented as ovals 870, 872, 874, 876 and 878.

FIG. 8E illustrates an exemplary three dimensional folded antenna structure 865 according to one embodiment of the disclosure. Antenna structure 865 represents a folded configuration of antenna structure 800 illustrated in FIG. 8A. It must be noted that antenna structure 865 is exemplary. Antenna structure 800 may be folded to implement a number of varying configurations.

Figure 9:
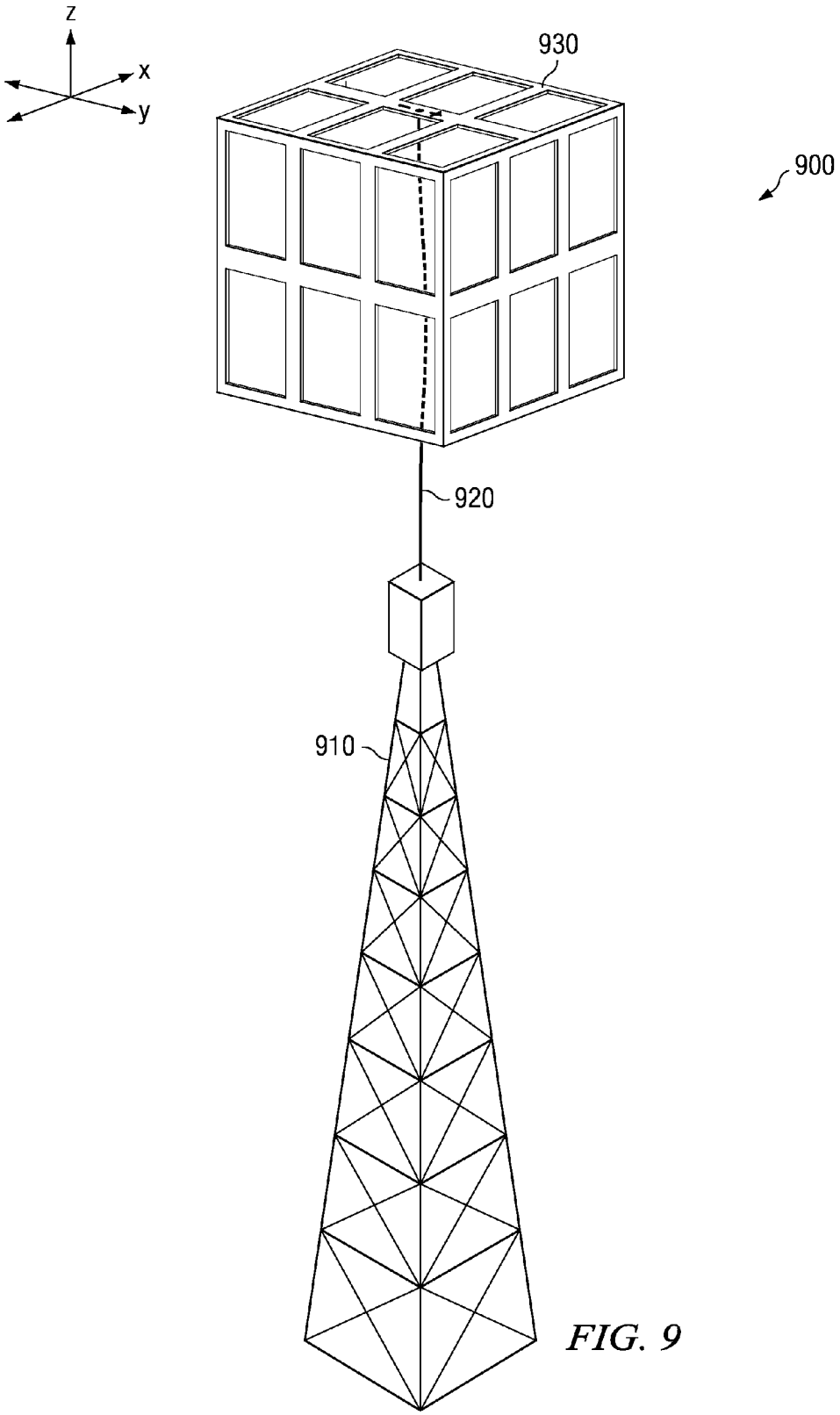
FIG. 9 illustrates a top level base transceiver system implementing the antenna of FIG. 8B according to one embodiment of the disclosure.

FIG. 9 illustrates a system 900 in which the three dimensional antenna structure, such as three dimensional antenna structure 930, may be implemented according to one embodiment of the disclosure. In FIG. 9, a radiating three dimensional structure 930 may be mounted to base transceiver station 910 through a coaxial cable feedline 920. In this embodiment, radiating three dimensional structure 930 may represent a folded configuration of the antenna structure illustrated in FIG. 8B. Coaxial cable feedline 920 is represented as a dotted line because it cannot be directly viewed from the exterior of antenna structure 930 because of the interior ground plane. Coaxial cable feedline 920 provides a current feed to the three dimensional antenna structure 930 from a feedpoint at a center of the antenna structure 930.

In this embodiment, radiating three dimensional structure 930 may represent a folded configuration of the antenna structure illustrated in FIG. 8B. It must be noted that the radiating three dimensional structure 930 has a planar face in the x, y, and z directions. Therefore, antenna structure 930 may simultaneously receive signals being broadcast in the x, y, and z planes.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein.

The embodiment or embodiments selected are chosen and described in order to best explain the principles of the embodiments, the practical application, and to enable others of ordinary skill in the art to understand the disclosure for various embodiments with various modifications as are suited to the particular use contemplated. For example, the various elements or components may be combined or integrated in another system or certain features may be omitted or not implemented.

Also, techniques, systems, and subsystems, and described and illustrated in the various embodiments as discrete or separate may be combined or integrated with other systems, modules, or techniques without departing from the scope of the present disclosure. Other items shown or discussed as coupled or directly coupled or communicating with each other may be indirectly coupled or communicated through some other interface, device or intermediate component whether electrically, mechanically, or otherwise. Other examples of changes, substitutions, and alterations are ascertainable by one skilled in the art and could be made without departing from the spirit and scope disclosed herein.

What is claimed is:

1. A dual polarization antenna comprising:

a rectangular closed loop radiating element having a perimeter length equivalent to a wavelength $\lambda$ of an operational frequency of the antenna;

a single feed point disposed within the perimeter of the closed loop radiating element, a pair of terminals referenced as a respective positive terminal and a negative terminal aligned along a line bisecting said closed loop radiating element into an upper portion and lower portion, the feed point defining a point of symmetry between the upper portion and the lower portion, the positive terminal connectable to an inner conductor of a coaxial feed and the negative terminal connectable to an outer conductor of the coaxial feed; and a number of microstrip elements disposed within the perimeter of the closed loop radiating element and arranged to form loops of different rectangular configurations with the closed loop radiating element;

the closed loop radiating element and the microstrip elements lying in a common plane, one of said number of microstrip elements connecting the positive terminal to the closed loop radiating element at a first location and another of the number of microstrip elements connecting the negative terminal to the loop radiating element at a second location opposite said first location, said first location and second location lying on said bisecting line, the single feed point inducing in a far-field dual mutually orthogonal polarized radiation;

wherein the rectangular closed loop radiating element and loops of different rectangular configurations are configured of microstrip elements having a same width and wherein the upper portion and lower portion each comprise first and second rectangular loops wherein the first rectangular loop is twice as wide as the second rectangular loop.

2. The antenna of claim 1, further comprising:

a base transceiver station comprising an interface that mounts the antenna and connects the coaxial cable to the feed point.

3. The antenna of claim 1, further comprising:

a dielectric plane parallel to the plane of the antenna; and a via opening in the center of the dielectric plane through which the feed point is disposed.

4. The antenna of claim 1, wherein the feed point is at a midpoint within the perimeter of the loop.

5. The antenna of claim 1, wherein the antenna is configured to radiate omnidirectionally.

6. The antenna of claim 1, wherein the loops are configured to induce a field polarization in the horizontal and vertical directions.

* * * * *